US008094834B1

(12) United States Patent
Brungart

(10) Patent No.: US 8,094,834 B1
(45) Date of Patent: Jan. 10, 2012

(54) REMOTE AUDITORY SPATIAL COMMUNICATION AID

(75) Inventor: Douglas S. Brungart, Bellbrook, OH (US)

(73) Assignee: The United States of America as represented by the Secretary of the Air Force, Washington, DC (US)

( * ) Notice: Subject to any disclaimer, the term of this patent is extended or adjusted under 35 U.S.C. 154(b) by 549 days.

(21) Appl. No.: 12/313,037

(22) Filed: Nov. 14, 2008

(51) Int. Cl.
*H04R 3/00* (2006.01)

(52) U.S. Cl. ..... 381/92; 381/1; 381/17; 381/18; 381/19; 381/26; 381/57; 381/111; 381/122; 381/300; 381/304

(58) Field of Classification Search ..... 381/26, 381/57, 300, 304, 92, 1, 17, 18, 19, 111, 381/122
See application file for complete search history.

(56) References Cited

U.S. PATENT DOCUMENTS

| | | | | |
|---|---|---|---|---|
| 6,118,875 | A | 9/2000 | Moller et al. | |
| 7,684,570 | B2 * | 3/2010 | Riggs | 381/86 |
| 2004/0076301 | A1 * | 4/2004 | Algazi et al. | 381/17 |

OTHER PUBLICATIONS

Marston et al., "Evaluation of Spatial Displays for Navigation without Sight," ACM Transactions on Applied Perception, vol. 3, No. 2, Apr. 2006, pp. 110-124.
Algazi et al., "The CIPIC HRTF Database", Proceedings of 2001 IEEE Workshop on Applications of Signal Processing to Audio and Acoustics, New Paltz, NY, Oct. 21-24, 2001, pp. 99-102.
Martin et al., "Interpolation of Head-Related Transfer Functions," Tech. Rep. DSTO-RR-0323, Defense Science and Technology Organization, http://dspace.dsto.defence.gov.au/dspace/bitstream/1947/8028 /1/DSTO-RR-0323.PR.pdf, (2007).
Langendijk et al., Fidelity of three-dimensional-sound reproduction using a virtual auditory display The Journal of the Acoustical Society of America, 107(1), 528-537, (2000).
Gardner et al., "HRTF measurements of a KEMAR," Journal of the Acoustical Society of America, 97, 3907-3908, (1995).
Giudice et al., "Wayfinding with words: spatial learning and navigation using dynamically updated verbal descriptions," Psychological Research 71:347-358, (2007).
Koo et al., "Enhancement of 3D Sound using Psychoacoustics," Proceedings of World Academy of Science, Engineering and Technology, vol. 27, pp. 162-166, (2008).
Kulkarni et al., "Sensitivity of human subjects to head-related transfer function phase spectra," Journal of the Acoustical Society of America, 105(5), 2821-2840, (1999).
Macpherson et al., "Vertical-plane sound localization probed with ripple-spectrum noise," The Journal of the Acoustical Society of America, 114(1), 430-445, (2003).
Middlebrooks et al., "Psychophysical customization of directional transfer functions for virtual sound localization," The Journal of the Acoustical Society of America, 108(6), 3088-3091, (2000).
Middlebrooks, J. C., "Individual differences in external-ear transfer functions reduced by scaling in frequency," The Journal of the Acoustical Society of America, 106(3), 1480-1492, (1999).

(Continued)

*Primary Examiner* — Wai Sing Louie
(74) *Attorney, Agent, or Firm* — AFMCLO/JAZ; Charles Figer

(57) ABSTRACT

The present invention provides a means for two or more remotely-located individuals to communicate information about the spatial coordinates of a location of mutual interest in a more rapid, robust, and intuitive manner than is possible with any current voice communication system.

20 Claims, 3 Drawing Sheets

OTHER PUBLICATIONS

Middlebrooks, J. C., "Virtual localization improved by scaling nonindividualized external-ear transfer functions in frequency," The Journal of the Acoustical Society of America, 106(3), 1493-1510, (1999).

Wilson et al., "SWAN: System for Wearable Audio Navigation," Proceedings of the 11th International Syposium on Wearable Computers, (2007).

Wallach, H., "The role of head movements and vestibular and visual cues in sound localization," Journal of Experimental Psychology, 27,339-368, (1940).

Kistler et al., "A model of head-related transfer functions based on principal components analysis and minimum-phase reconstruction," Journal of the Acoustical Society of America, 91, 1637-1647, (1992).

Wightman et al., "Headphone simulation of free-field listening. II: Psychophysical validation," Journal of the Acoustical Society of America, 85, 868-878, (1989).

* cited by examiner

REMOTE AUDITORY SPATIAL COMMUNICATION AID

RIGHTS OF THE GOVERNMENT

The invention described herein may be manufactured and used by or for the Government of the United States for all governmental purposes without the payment of any royalty.

BACKGROUND OF THE INVENTION

The invention relates to rapidly and intuitively conveying information about the spatial location of an observed object or event to one or more listeners by projecting the apparent sound of a verbal message to the location referred to by that message, thus enhancing the listener's ability to rapidly identify and appropriately react to the object or event occurring at that location.

In many tasks that involve real-time coordination between two or more remotely located individuals, the need arises for one person to rapidly and intuitively convey information about the spatial location of an observed object or event to one or more listeners. As an example, consider the case of a military operation where a pilot located in a helicopter spots an enemy sniper hidden in the window of a building in a crowded urban environment. In such a situation, it is extremely urgent for the pilot to communicate both the location of the threat and its description to friendly troops on the ground in the most efficient manner possible.

With current communication systems, the pilot has a number of possible options for the communication of this information. The pilot may provide a verbal description of the location of the threat, typically with a radio, with references to local landmarks that are visible both to the observer and to the troops on the ground. For example, the pilot might say "There's a sniper on the roof of the building with the blue awning to the right of the third vehicle in the caravan north bound on Alpha Street." This approach has a number of major drawbacks. There can be considerable ambiguity in the interpretation of the landmarks in the description (e.g., "did he mean that building with the blue awning?"). The description requires the listener to spend time scanning the environment for landmarks when that time would be better spent searching for cover; and depending on their relative locations, listeners located in different orientations relative to the threat may require different verbal descriptions to find the relevant location.

Another possible approach is for the observer to perform the necessary geometric calculations and determine the location of the threat relative to the location of the listener using range and bearing information. For example, the pilot could tell a listener that the threat is located 500 m to the north. This approach is less ambiguous than the verbal description approach, but it also has serious challenges. First, it requires the observer to know precisely where the listener is located, which may not always be the case in real-world situations. Second, it requires the observer to make time-consuming, cumbersome, and potentially error-prone calculations about the relative locations of the threat and the listener. Finally, it can only be applied to a single listener at a time. If it is necessary to convey the information to two listeners, one located east of the threat and one located north of the threat, two different calculations and two different verbal communications will be necessary.

The pilot may alternatively provide a GPS coordinate of the threat. This approach provides unambiguous information about the location of the threat, but also has substantial drawbacks. First, it requires the observer to obtain the GPS coordinates of the threat, which may not be immediately accessible if the target is visually detected out of the window of a helicopter. Second, it requires the successful communication of a complex string of numbers, which may result in miscommunication or possible incorrect transcription by the listener (who almost certainly will need to write down the coordinates in order to remember them). And third, it requires the listener to determine his or her own GPS location and apply a complicated mathematical calculation to determine the relative location of the threat.

A more technologically advanced approach to the problem would be for the observer to identify the GPS location of the threat with a location-determining device such as a laser rangefinder, and use a data network to transmit this information to a computer display at the location of the listener, thus placing a visual icon on the location of a moving map displayed to the observer on a screen. This approach provides unambiguous location information with little chance for transcription errors, but it requires the operator to view a screen and making a potentially cumbersome translation between a map display and the surrounding terrain when that time would be better spent either taking cover of visually scanning the environment for the threat.

None of these approaches are successful in achieving the true goal of the observer, which is to 1) verbally convey the location of the threat in a manner that is completely intuitive to all the potential listeners in the environment and 2) allow them to react immediately without pausing to perform any geometric calculations to determine the relative location of the threat. The remote auditory spatial communication aid described herein has numerous advantages over the existing techniques in the prior art for addressing this problem, including faster response time, fewer chances for human error, compatibility with other heads-up, eyes-out, hands-on tasks, and greatly reduced operator workload.

SUMMARY OF THE INVENTION

A Remote Audio Spatial Communication Aid (RASCA) and method for a voice communication system that is designed to provide an immediate, robust, and intuitive means for two individuals in two different locations to exchange verbal information related to a third spatial "reference" location. The system consists of two components. The first component is a "transmitter" system consisting of a device that allows individuals to select the coordinates of a remote reference location (such as a laser rangefinder device or a mouse cursor on a map display), a microphone with a push-to-talk switch, and a data transmission system capable of transmitting both the talker's voice and the coordinates of the reference location to the listener. The second component is a "receiver" system consisting of a data reception system capable of picking up the reference location coordinates and the talkers voice from the location of the talker, a position tracking system capable of determining the location and orientation of the listener's head in the relevant coordinate system (either real-world coordinates or coordinates on a visual map display), and a head-related transfer function (HRTF) based spatial audio display capable of spatializing the apparent location of the talker's voice so that it appears to originate from reference location selected by the talker. The resulting system improves the efficiency of human-to-human spatial communication and reduces the probability of human error due to incorrectly interpreted verbal coordinates or land-mark based verbal descriptions.

Potential applications of the present invention include any military or commercial application that requires spatially distributed individuals to exchange spatial information. Examples include: forward air controllers communicating targeting information with to air support aircraft; UAV sensor operators communicating with commanders and forward-deployed ground personnel; air battle managers and/or air traffic controllers communicating with pilots; airborne law enforcement in a helicopter personnel communicating the movements of a fleeing criminal to pursuing ground personnel. Other potential users of the system may include search and rescue operators; police and fire dispatchers; ground delivery personnel requesting navigation information from a dispatcher; mobile phone users who might call a friend with access to a map display on a computer and ask for directions to a desired location; visually impaired individuals using a telephone-based navigation; commercial air traffic controllers relaying traffic warnings or navigation directions to pilots, or just about any other user that needs to communicate line of sight location information in as rapidly as possible.

DETAILED DESCRIPTION

The present invention includes a Remote Audio Spatial Communication Aid (RASCA) and a method of same. The present invention allows an observer to select an arbitrary location and transmit his or her voice or some other indicator sound in such a way that each and every listener on the communication channel will hear that voice or sound coming from the direction of the selected location relative to his or her current position, independent of the relative locations of the observer, the target location, and the listeners. In the case of the military operation described above, this would mean that the helicopter pilot would simply have to highlight the location of the sniper with a laser rangefinder or equivalent location-finding device, press a push-to-talk switch, and say "There's a sniper over here." As a result, every soldier on the ground, no matter what their orientation might be relative to the sniper, would hear the pilot's voice coming from the location of the sniper, and consequently they would be able to take immediate corrective action without even a moment's pause to check a map, consult a compass, perform a geometric calculation or scan the environment for visual landmarks.

Figure 1:
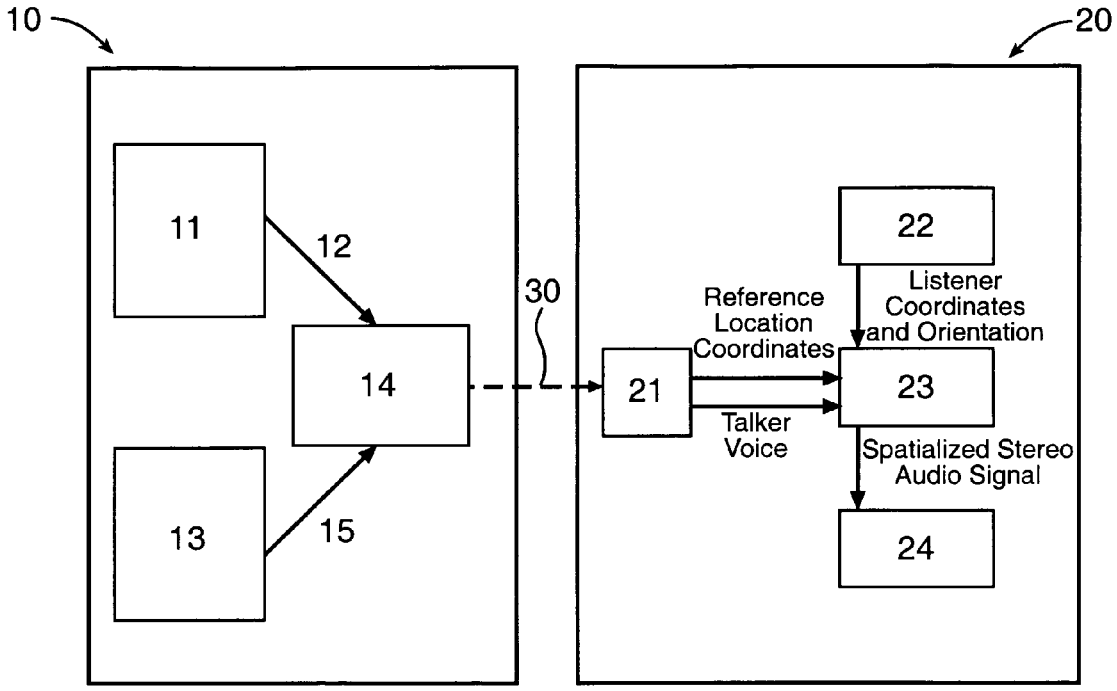
FIG. 1 is a block diagram of a transmitter and a receiver.

A Remote Audio Spatial Communication Aid (RASCA) invention includes a transmission system 10, and a receiver system 20, a block diagram of which is shown in FIG. 1.

The transmission system 10 may include a coordinate identifier 11 that allows the observer to select a location of interest (reference location) and automatically obtain spatial coordinates 12 of that location of interest. A sound source 13 that provides a sound 15 such as a warning tone generator or a voice microphone. The transmission system further includes a transmitter 14 that electronically sends the sound 15 and spatial coordinates 12 through a data link 30. The data link may be any data link known in the art including a wireless or terrestrial data link.

The receiver system 20 may include a receiver 21 at a listener location that electronically receives the sound 15 and spatial coordinates 12 of the location of interest from the transmission system 10 via the data link 30. The receiver system 20 may further include a head tracker 22 that preferably determines the spatial location and orientation (azimuth, elevation and roll) of a listener's head; and a spatial audio system 23 that determines the direction and distance of the location of interest (reference location) relative to the location and orientation of the listener's head and uses a head-related transfer function (HRTF) process to modify the acoustics characteristics of the sound 15 so that it appears to originate from the location of interest (reference location). A stereo sound reproduction device 24 such as headphones or ear buds may be used to present the spatially processed voice signal to the listener's ears using at least interaural time and intensity differences such that the sound, when analyzed by the listener "sounds" like it is coming from the location of interest.

In one embodiment of the RASCA system, the voice signal recorded by the microphone and the GPS coordinate of the reference location reported by the laser rangefinder are routed into an "audio encoder" subsystem that embeds the GPS coordinate directly into the audio speech signal. This embedding of the GPS coordinate is accomplished via a robust "audio, watermarking" procedure described in detail by Hofbauer and Kubin in *High-rate data embedding in unvoiced speech*," in Proceedings of the International Conference on Spoken Language Processing (INTERSPEECH), (Pittsburgh, Pa., USA), September 2006 and Hofbauer, K and H. Hering, H, "*Noise Robust Speech Watermarking with Bit Synchronisation for the Aeronautical Radio*," in Information Hiding, vol. 4567/2008 of Lecture Notes in Computer Science, pp. 252-266, Springer-Verlag, 2007, both incorporated herein by reference.

This procedure modifies the speech by replacing the random noise-like unvoiced speech segments that occur in natural speech with a carefully constructed noise-like audio signal that embeds digital data in the voice stream at a rate ranging from 100 to more than 2000 bits per second. The embedding is done in such a way that the modification is nearly imperceptible to a human listener. It also has the advantage that it is completely ignored by radios that are not compatible with the system. Using this system, it may be possible to imperceptibly encode the full GPS coordinate representing the reference location into the speech signal within the first second of the speech transmission. This audio watermarking procedure has the advantage that both the voice and the reference location could be sent by a standard analog voice radio without requiring a separate data network to send the reference coordinate. However, it should be noted that this reference coordinate could alternatively be transmitted via a wireless Ethernet network or any other wireless or terrestrial data link technology. The output of the "audio encoder" subsystem is an analog audio signal that can be transmitted via any desired analog audio radio. The combination of the "audio encoder" and the "analog radio" comprises the "transmission system" in the current implementation of the system.

Figure 2:
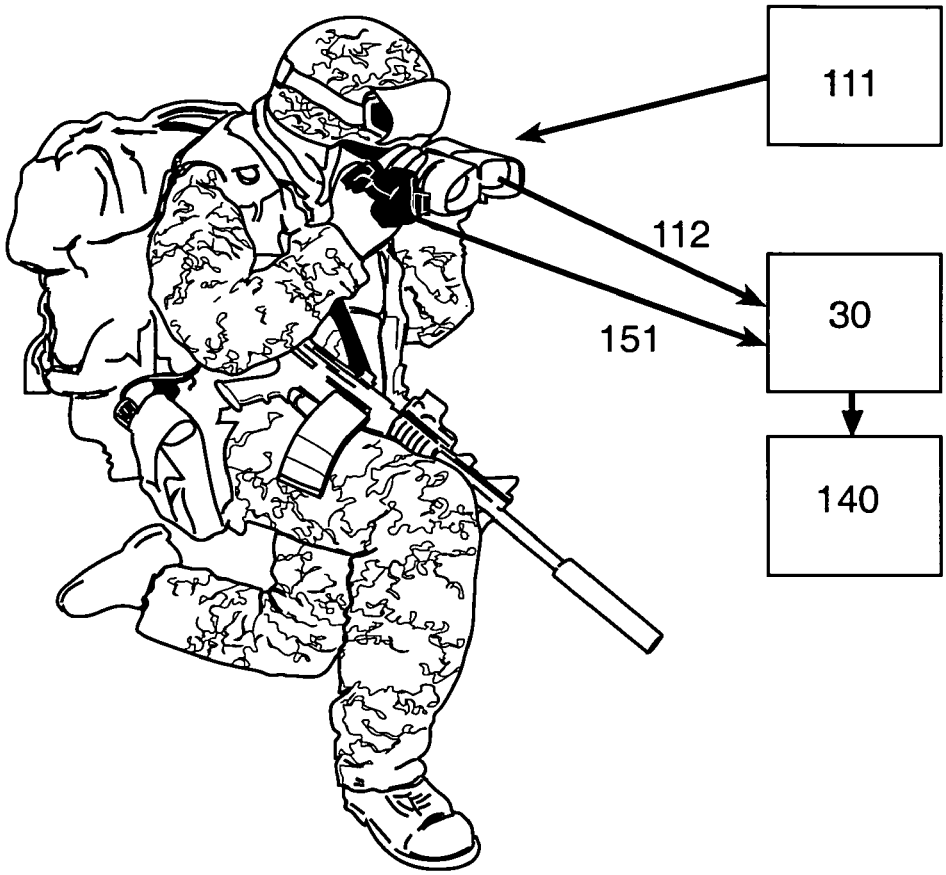
FIG. 2 is an illustration of a transmission system.

FIG. 2 is one embodiment of the transmission system 10 that includes a GPS laser rangefinder 111. The GPS rangefinder 111 includes devices such as the commercially available LP10TL device from Simrad. These devices consist of a GPS transponder for determining the GPS location of the device; an optical viewer with a reticle for identifying a distant location within the line of sight of the operator; a laser rangefinder device for determining the distance of the identified location; and a digital compass and/or inclinometer for determining the orientation of the rangefinder. The range finder data 112 along with a sound either vocal or electronic is communicated to an optional analog encoder 30 and transmitted using an analog radio 140 as the transmitter (Transmitter 14 in FIG. 1).

In one embodiment, the global positioning system (GPS) may include a two-dimensional coordinate directional feature as well as a laser distance determination feature.

Figure 3:
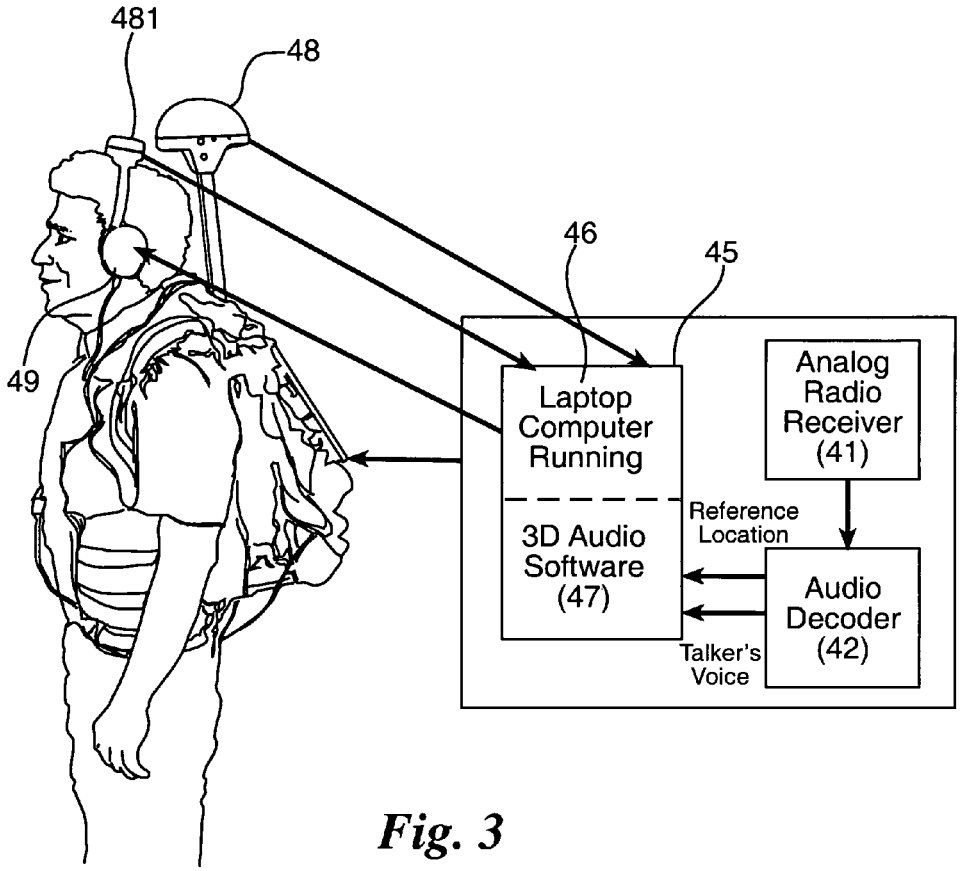
FIG. 3 is an illustration of a receiver system.

An embodiment of a receiver system 40 is shown in FIG. 3. The receiver system 40 may include an analog radio receiver 41 an audio decoder 42 and a man-portable spatial audio system 45. The man-portable spatial audio system 45 may include a laptop computer 46 running spatial audio software (Three-dimensional) that implements the head-related transfer function (HRTF) 47. The receiver system 40 may further include a GPS enabled head-tracker 48 that also includes a listeners head mounted compass and/or orientation device 481. The spatial audio software 47 may deliver a simulated sound to the listener through stereo headphones 49.

The simulated sound accounts for both interaural volume and delay characteristics embodied in the head-related transfer function (HRTF) that "tell" a listener where the sound is coming from.

The spatial audio software 47 may be implemented with commercially available, open source software such as the "Sound Lab" (SLAB) software developed by J. D. Miller, "SLAB: A software-based real-time virtual acoustic environment rendering system." [Demonstration], ICAD 2001, 9th Intl. Conf. on Aud. Disp., Espoo, Finland, 2001. The audio decoder algorithm used to extract the spatial coordinates from the voice signal (42) was described in Hofbauer, K and Kubin, G, "High-rate data embedding in unvoiced speech," in Proceedings of the International Conference on Spoken Language Processing (INTERSPEECH), (Pittsburgh, Pa., USA), September 2006.

One key novel aspect of the present invention is the use of the reference coordinates transmitted by the transmission system to spatialize the apparent location of the target talker's voice at the reference location.

In an alternate embodiment of the RASCA, the coordinate identifier used in the transmission system may be selected via the use of an electronic map or a remote sensor display viewed on a computer display rather than via direct identification of a reference location with a visual rangefinding device. One embodiment may include the use of a mouse cursor to specify the reference location of a voice message. In one embodiment, the computer screen would be displaying a map where a click of the mouse would indicate the coordinate from which the sound of the talker's voice should appear to emanate in the stereo sound reproduction device. In another embodiment, the computer screen might provide a view from a remote camera or other sensor, as from an unmanned air vehicle, and the cursor would be used to determine the geographic coordinates corresponding to an object or event viewed on the computer display.

In another alternative embodiment of the RASCA, the receiving system would spatialize sounds at their apparent locations relative to geographic coordinates displayed on a large wall map or other computer display. In this embodiment, the position of the reference location on the map display would be calculated relative to the location and orientation of the listener's head, and the talker's voice would be processed in such a way that it would appear to originate from the position of the reference location on the large scale map. In some cases, this implementation of the invention might involve the spatialization of audio signals related to reference locations that are close to, but outside of, the geographic area displayed by the map. These voice signals could still be rendered in the same spatial coordinate system as the map display but outside the field of view. Thus, for example, an audio signal referencing a location slightly to the east of the field of view would be heard slightly to the right of the computer displayed map. This would allow the listener to obtain spatial awareness of events occurring outside the field of vision. Another alternative embodiment would be the capability to link the direction of view of the receiver such that when the listener looked in the direction of the reference location a communicative tone got louder or a beep or buzz become more frequent, or both. This option would preferably be selectable by the listener. In each case, the technology offers a significant improvement over the current state of the art because it presents the spatial information in the same coordinate system the listener is currently operating in and this makes it vastly easier for the user to correctly interpret and correctly respond to this spatial information without requiring complicated mental calculations or transformations.

The extremely important aspect of human communication that has been missed in the prior art with spatial audio displays is the fact that, in many cases, the important spatial context related to a human speech signal is not the location where the talker is located, which is many cases is already known by the listener, but rather the location that specific speech utterance is referring to. In face-to-face communication, these reference locations are almost always referenced with visual cues, (e.g., by physically pointing at the reference location while talking). Thus; for example, a talker might point at a tree and say "do you see that tree over there." In telecommunications, this capability is completely lost. Even in video conferencing, where the listener can see the talker's face, the ability to indirectly reference location in speech is lost because the listener cannot typically see where the talker is pointing.

By encoding a reference location in a speech signal, the talker is able to focus on the content of the speech message (the what) rather than on a description of the location referred to in the speech message (the where). By hearing the speech message at the reference location, the listener is able to intuitively and immediately put together the contents of the speech message together with its spatial context, thus decreasing mental workload and reaction time. By completely bypassing the need to describe spatial location in terms of visual references or spatial coordinates, the audio annotation system reduces or eliminates a huge potential avenue for human error, and in many time-critical military or search-and-rescue situations the time savings gained through the use of the audio annotation technique could save lives.

The operational advantages of the RASCA technique over these other techniques have been experimentally demonstrated. A simulation study at Wright-Patterson AFB, OH required a dismounted soldier in a simulated immersive urban environment to navigate through a maze of buildings in order to locate and rescue a downed pilot. While navigating the maze, the operator was also required to monitor the locations of potential adversaries embedded within the urban maze, and engage those adversaries who signaled hostile intent by raising a weapon in their direction. Once this weapon was raised, the operator had to shoot and kill the enemy combatant within five seconds to avoid being hit by enemy gunfire. While performing this task, the operator was aided by a remote observer who was provided with an abstract computer-generated top-view map of the environment showing the location of the operator, the location of the downed pilot, and the locations of the hostile enemies within the environment. In one condition, the remote observer used a conventional radio intercom to communicate to the operator. In the second condition, the remote observer was provided with an audio annotation system that allowed them to designate a reference location by clicking a mouse pointer at location on the map, and then talking into a microphone. Their voice was then processed by a spatial audio display in such a way that the operator inside the urban environment would hear the remote observer's voice originate from the selected reference location. This allowed the operator to use more telegraphic voice commands like "come this way" or "enemy over here" to provide directions to the operator, rather than more complex location-intensive commands like "turn left at the intersection" or "hostile located at 3 o'clock".

Experimental results from a total of 256 search-and-rescue trials showed that the audio annotation technology led both to a 15% decrease in the time required to locate the downed pilot, and a 33% decrease in the number of times the operator was hit by hostile gunfire. These results provide heightened confidence in the operational utility of the audio annotation technique for tasks involving the communication of spatial information between remotely located individuals.

Exemplary software code for a remote viewer application to place the audio entity on the map uses the COMM channel. The software finds the position in the world from the screen coordinates then that info is packaged and sent to the visual simulation via a TCP/IP message "COMM ADD . . . " This section of code places the sound when clicked and ends the sound when clicked again. The push to talk is done by deleting the sound icon as soon as the mouse button is released. The code includes:

```
case 3: //COMM
deletecheck=false;
if ((MyGS.CommLocal.x==newx) && (MyGS.CommLocal.y==newy)) {
GetScene( )->GetSceneNode( )->removeChild(CommLocal);
MyGS.CommLocal.x=10000;
MyGS.CommLocal.y=10000;
currentCommLocal=0;
deletecheck=true;
if (connect_btn->getText( )=="Disconnect") {
char message[256];
sprintf_s(message, 256, "COMM DEL\n");
if (!mySocket->sendline(message)) {
Log::GetInstance( ).LogMessage(Log::LOG_ALWAYS, _FUNCTION_, "Failed
to send test message");
}
}
}
if (!deletecheck) {
if (currentCommLocal==0) {
CommLocal=new osg::Billboard( )
CommLocal->setMode(osg::Billboard::POINT_ROT_EYE);
CommLocal->addDrawable(
createSquare(osg::Vec3(ny,-0.1f,
nz),osg::Vec3(1.0f,0.0f,0.0f),osg::Vec3(0.0f,0.0f,1.0f), osgDB::readImageFile(
"c.png")), osg::Vec3(0.0f,0.0f,0.0f));
GetScene( )->GetSceneNode( )->addChild(CommLocal);
MyGS.CommLocal.x=newx;
MyGS.CommLocal.y=newy;
if (connect_btn->getText( )=="Disconnect") {
char message[256];
printf("x=%If, y=%If\n", newx, newy);
sprintf_s(message, 256, "COMM ADD %d %d %d\n", currentCommLocal,
newx, newy);
if (!mySocket->sendline(message)) {
Log::GetInstance( ).LogMessage(Log::LOG_ALWAYS, _FUNCTION_, "Failed
to send test message");
}
}
currentCommLocal++;
//printf("currentCommLocal=%d\n", currentCommLocal);
} else if (currentCommLocal==1) {
//CommLocal->setPosition(0, osg::Vec3(ny,-0.1f, nz));
GetScene( )->GetSceneNode( )->removeChild(CommLocal);
CommLocal=new osg::Billboard( )
CommLocal->setMode(osg::Billboard::POINT_ROT_EYE);
CommLocal->addDrawable(
createSquare(osg::Vec3(ny,-0.1f,nz),osg::Vec3(1.0f,0.0f,0.0f),osg::Vec3(0.0f,0.0f,1.00,osgDB::readImage
File("c.png")), osg::Vec3(0.0f,0.0f,0.0f));
GetScene( )->GetSceneNode( )->addChild(CommLocal);
MyGS.CommLocal.x=newx;
MyGS.CommLocal.y=newy;
if (connect_btn->getText( )=="Disconnect") {
char message[256];
sprintf_s(message, 256, "COMM ADD %d %d %d\n", currentCommLocal,
newx, newy);
if (!mySocket->sendline(message)) {
Log::GetInstance( ).LogMessage(Log::LOG_ALWAYS, _FUNCTION_, "Failed
to send test message");
}
}
}
}
return true;
break;
```

The visual application receives the COMM messages and processes them to control the WinAudioServer (SLAB application)

Here is the function that processes the incoming messages:

```
int rvInterface::ProcessMessage(char* message)
{
if (message==NULL)
return 0;
char seps[ ]=" ";
char *token;
char string[256];
strncpy(string, message, 256);
token=strtok(string, seps);
if (strcmp(token, "COMM")==0) {
token=strtok(NULL, seps);
if (strcmp(token, "ADD")==0) {
int x, y, n;
n=atoi(strtok(NULL, seps));
x=atoi(strtok(NULL, seps));
y=atoi(strtok(NULL, seps));
PosComm(x, y);
CommOn=true;
} else if (strcmp(token, "DEL")==0) {
CommOn=false;
} else if (strcmp(token, "ON")==0) {
CommOn=true;
} else if (strcmp(token, "OFF")==0) {
CommOn=false;
}
```

```
} else if (strcmp(token, "WAY")==0) {
token=strtok(NULL, seps);
if (strcmp(token, "ADD")==0) {
int x, y, n;
n=atoi(strtok(NULL, seps));
x=atoi(strtok(NULL, seps));
y=atoi(strtok(NULL, seps));
PosWaypoint(x, y);
WayOn=true;
} else if (strcmp(token, "DEL")==0) {
WayOn=false;
}
} else if (strcmp(token, "HOS")==0) {
token=strtok(NULL, seps);
if (strcmp(token, "ADD")==0) {
int x, y, n;
n=atoi(strtok(NULL, seps));
x=atoi(strtok(NULL, seps));
y=atoi(strtok(NULL, seps));
PosHostile(n, x, y);
HosOn[n]=true;
} else if (strcmp(token, "DEL")==0) {
int n;
n=atoi(strtok(NULL, seps));
HosOn[n]=false;
}
}
return 1;
}
```

And here is the PosComm function that gets called by ProcessMessage, it sets the position variables

```
void rvInterface::PosComm(int x, int y)
{
CommX=x;
CommY=y;
//cout<<x>>" "<<y<<endl;
}
```

Then finally in the main loop of the application this code gets called to update the Comm channel in slab It is converting the position to polar then sending it to the slab server via the vcSlabAudio class.

```
if (rvInterface::GetCommOn( )) {
//calc real pos here
double comm_dist, comm_az;
vuVec3<double> cPos;
if ((SC.ConditionNumber==3)||(SC.ConditionNumber==4)) {
cPos[0]=rvInterface::GetCommX( )*5.0;
cPos[1]=rvInterface::GetCommY( )*5.0;
cPos[2]=0.0;
comm_dist=sqrt(pow(pos[0]-cPos[0], 2)+pow(pos[1]-cPos[1], 2));
comm_az=180.0+((atan2(pos[0]-cPos[0], pos[1]-cPos[1])*(180.0/PI))+
ort[0]);
if (comm_az>180.0)
comm_az=comm_az−360.0;
if (comm_az<−180.0)
comm_az=comm_az+360.0;
vcSlabAudio::SendCommUpdate(comm_az, 0.0, comm_dist);
} else if ((SC.ConditionNumber==1)||(SC.ConditionNumber==2)) {
vcSlabAudio::SendCommUpdate(0.0, 0.0, 1.0);
}
} else {
vcSlabAudio::SetCommDisable( );
}
```

Here is SendCommUpdate it calls the function SendPresentSourcePolar that sends the generic PresentSourcePolar command to the slab audio server. The CommSource on the slab server is initialized in this class when the application is first run.

```
int vcSlabAudio::SendCommUpdate(double az, double el, double dist)
{
if(((vuDistributed::getMode( )==vuDistributed::MODE_MASTER)||
(vuDistributed::getMode( )==vuDistributed::MODE_INACTIVE)) &&
(Initialized)) {
if (!enabledComm) {
if (SetSourceEnable(CommSource))
enabledComm=1;
cout<<"vcSlabAudio::SendCommUpdate-Enabling at"<<az<<" "<<dist
<<" "<< CommSource<<endl;
SendPresentSourcePolar(CommSource, az, el, dist);
}
} else {
SendUpdateSourcePolar(CommSource, az, el, dist);
}
return 1;
} else return 0;
}
```

While specific embodiments have been described in detail in the foregoing description and illustrated in the drawings, those with ordinary skill in the art may appreciate that various modifications to the details provided could be developed in light of the overall teachings of the disclosure.

What is claimed is:

1. A Remote Audio Spatial Communication Aid (RASCA) for a listener with a listener location and a listener head orientation, the RASCA including:

a transmitter system including, a coordinate identifier to establish a coordinate, wherein the coordinate identifier includes a laser rangefinder and a GPS;

a sound source generating a sound, a data transmission system, transmitting data that includes at least the sound and coordinates;

a receiver system to receive the transmitted data, the receiver system capable of determining the listener location and the listener head orientation with respect to the coordinate;

a spatial audio system including, a head-related transfer function (HRTF) converting the sound and coordinates to a specified apparent location wherein the sound appears to emanate from the coordinates, the sound emanating from a stereo sound reproduction device.

2. The RASCA of claim 1 wherein the sound source consists of a voice microphone and the sound is a voice.

3. The RASCA of claim 1 where the transmitter consists of a Global Positioning System (GPS) laser rangefinder modified to incorporate a voice microphone and a push-to-talk switch.

4. The RASCA of claim 1 wherein the transmission system uses audio watermarking to encode the coordinates of the reference location in an analog signal.

5. The RASCA of claim 4 wherein the coordinates are Global Positioning System (GPS) coordinates and the analog signal is a voice signal.

6. The RASCA of claim 1 wherein the receiver system includes a head tracker.

7. The RASCA of claim 1 wherein the receiver system includes a GPS system to determine the listener location and a compass to determine the listener head orientation.

8. The RASCA of claim 1 wherein the receiver system includes a tone that changes volume and frequency depending upon the listener head orientation with respect to the coordinates.

9. The RASCA of claim 1 wherein the coordinate identifier is a mouse cursor on a computer screen, the computer screen displaying a map or a remote sensor feed such as a camera, a mouse click indicating the coordinate.

10. The RASCA of claim 1 wherein spatial audio software is used to position the sound at a specified apparent location on a computer displayed map or a remote sensor feed such as a camera.

11. A Remote Audio Spatial Communication Aid (RASCA) for a listener with a listener location and a listener head orientation, the RASCA including:

a transmitter system including, a coordinate identifier to establish a coordinate;

a sound source generating a sound, a data transmission system, transmitting data that includes at least the sound and coordinates;

a receiver system to receive the transmitted data, the receiver system capable of determining the listener location and the listener head orientation with respect to the coordinate;

a spatial audio system including, a head-related transfer function (HRTF) converting the sound and coordinates to a specified apparent location wherein the sound appears to emanate from the coordinates, the sound emanating from a stereo sound reproduction device;

wherein the receiver system includes a tone that changes volume and frequency depending upon the listener head orientation with respect to the coordinates.

12. The RASCA of claim 11 wherein the sound source consists of a voice microphone and the sound is a voice.

13. The RASCA of claim 11 wherein the coordinate identifier includes a laser rangefinder and a GPS.

14. THE RASCA of claim 13 where the transmitter consists of a Global Positioning System (GPS) laser rangefinder modified to incorporate a voice microphone and a push-to-talk switch.

15. The RASCA of claim 11 wherein the transmission system uses audio watermarking to encode the coordinates of the reference location in an analog signal.

16. The RASCA of claim 15 wherein the coordinates are Global Positioning System (GPS) coordinates and the analog signal is a voice signal.

17. The RASCA of claim 11 wherein the receiver system includes a head tracker.

18. The RASCA of claim 13 wherein the receiver system includes a GPS system to determine the listener location and a compass to determine the listener head orientation.

19. The RASCA of claim 11 wherein the coordinate identifier is a mouse cursor on a computer screen, the computer screen displaying a map or a remote sensor feed such as a camera, a mouse click indicating the coordinate.

20. The RASCA of claim 11 wherein spatial audio software is used to position the sound at a specified apparent location on a computer displayed map or a remote sensor feed such as a camera.

* * * * *